US009765504B2

(12) United States Patent
Jeon

(10) Patent No.: US 9,765,504 B2
(45) Date of Patent: Sep. 19, 2017

(54) HYDRAULIC SYSTEM FOR CONSTRUCTION MACHINERY

(75) Inventor: Man-Seuk Jeon, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 257 days.

(21) Appl. No.: 14/399,059

(22) PCT Filed: May 21, 2012

(86) PCT No.: PCT/KR2012/003992
§ 371 (c)(1),
(2), (4) Date: Nov. 5, 2014

(87) PCT Pub. No.: WO2013/176298
PCT Pub. Date: Nov. 28, 2013

(65) Prior Publication Data
US 2015/0113970 A1 Apr. 30, 2015

(51) Int. Cl.
*E02F 9/22* (2006.01)
*F15B 13/06* (2006.01)
(Continued)

(52) U.S. Cl.
CPC ..... *E02F 9/2292* (2013.01); *E02F 3/437* (2013.01); *E02F 9/2239* (2013.01);
(Continued)

(58) Field of Classification Search
CPC ..... E02F 9/2285; E02F 9/2292; E02F 9/2239; E02F 9/2242; E02F 3/437; F15B 11/17;
(Continued)

(56) References Cited

U.S. PATENT DOCUMENTS 5,890,303 A 4/1999 Ishikawa et al.
6,164,069 A * 12/2000 Takahashi ..... E02F 9/2239 60/421
(Continued)

FOREIGN PATENT DOCUMENTS

JP H11-013091 A 1/1999
KR 10-2010-0134827 A 12/2010
KR 10-2011-0075066 A 7/2011

OTHER PUBLICATIONS

International Search Report (in Korean and English) and Written Opinion (in Korean) for PCT/KR2012/003992, dated Feb. 1, 2013; ISA/KR.

*Primary Examiner* — Edelmira Bosques
*Assistant Examiner* — Michael Quandt
(74) *Attorney, Agent, or Firm* — Harness, Dickey & Pierce, P.L.C.

(57) ABSTRACT

Disclosed is a hydraulic system for performing land preparation works by means of a simultaneous boom-up and arm-in operation. The hydraulic system according to the present invention includes: an arm cylinder and a boom cylinder that are connected to first and second hydraulic pumps, respectively; a first boom control valve that is disposed in the discharge flow path of the second hydraulic pump; a second boom control valve that is disposed in the discharge flow path of the first hydraulic pump and causes the working fluid of the first hydraulic pump to converge with the working fluid which is supplied from the second hydraulic pump to the boom cylinder; a first arm control valve that is disposed in the discharge flow path of the first hydraulic pump; a second arm control valve that is disposed in the discharge flow path of the second hydraulic pump and causes the working fluid of the second hydraulic pump to converge with the working fluid which is supplied from the first hydraulic pump to the arm cylinder; a recycle valve that
(Continued)

is disposed in the flow path between the working fluid inlet port of the first arm control valve and a hydraulic tank; and a second boom control valve spool having a parallel pressure section in which the boom-up pilot pressure does not increase with respect to the boom-up strokes during the simultaneous boom-up and arm-in operation.

2 Claims, 3 Drawing Sheets

(51) Int. Cl.

| | |
|---|---|
| ***E02F 3/43*** | (2006.01) |
| ***F15B 11/17*** | (2006.01) |
| ***F15B 11/16*** | (2006.01) |
| ***F15B 13/02*** | (2006.01) |
| *E02F 9/20* | (2006.01) |

(52) U.S. Cl.
CPC ..... *E02F 9/2242* (2013.01); *E02F 9/2282* (2013.01); *E02F 9/2285* (2013.01); *F15B 11/162* (2013.01); *F15B 11/167* (2013.01); *F15B 11/17* (2013.01); *F15B 13/028* (2013.01); *F15B 13/06* (2013.01); *E02F 9/2004* (2013.01); *F15B 2211/20576* (2013.01); *F15B 2211/3052* (2013.01); *F15B 2211/30595* (2013.01); *F15B 2211/31* (2013.01); *F15B 2211/3116* (2013.01); *F15B 2211/31594* (2013.01); *F15B 2211/329* (2013.01); *F15B 2211/36* (2013.01); *F15B 2211/605* (2013.01); *F15B 2211/6355* (2013.01); *F15B 2211/7051* (2013.01); *F15B 2211/71* (2013.01); *F15B 2211/7142* (2013.01); *F15B 2211/785* (2013.01); *F15B 2211/851* (2013.01); *F15B 2211/853* (2013.01)

(58) Field of Classification Search
CPC .. F15B 11/162; F15B 13/022; F15B 2211/781
USPC ..... 91/513
See application file for complete search history.

(56) References Cited

U.S. PATENT DOCUMENTS

| | | | | |
|---|---|---|---|---|
| 7,127,887 | B2 * | 10/2006 | Nakamura | E02F 9/2228 60/421 |
| 8,387,376 | B2 * | 3/2013 | Son | F15B 11/17 60/394 |
| 8,733,391 | B2 | 5/2014 | Jeon | |
| 2010/0313557 | A1 | 12/2010 | Kim | |
| 2013/0228245 | A1 | 9/2013 | Ku et al. | |
| 2013/0277582 | A1 | 10/2013 | Kang et al. | |
| 2013/0333367 | A1 | 12/2013 | Jeon et al. | |

* cited by examiner

PRIOR ART

HYDRAULIC SYSTEM FOR CONSTRUCTION MACHINERY

FIELD OF THE INVENTION

The present invention relates to a hydraulic system for a construction machine. More particularly, the present invention relates to a hydraulic system for a construction machine, which enables a ground leveling work or a grading work that flattens a ground surface through the simultaneous performance of boom-up and arm-in operations.

BACKGROUND OF THE INVENTION

As shown in FIG. 1, a hydraulic system for a construction machine in accordance with the prior art includes:

first and second hydraulic pumps P1 and P2 and a pilot pump, which are connected to an engine (not shown);

an arm cylinder 2 that is connected to a discharge flow path 1 of the first hydraulic pump P1;

a boom cylinder 4 that is connected to a discharge flow path 3 of the second hydraulic pump P2;

a first boom control valve 5 that is installed on an upstream side of the discharge flow path 3 of the second hydraulic pump P2 and is configured to be shifted to control a start, a stop, and a direction change of the boom cylinder 4;

a second boom control valve 7 that is installed on an upstream side of the discharge flow path 1 of the first hydraulic pump P1 and is configured to be shifted to allow a hydraulic fluid discharged from the first hydraulic pump P1 to join a hydraulic fluid supplied to the boom cylinder 4 from the second hydraulic pump P2 through a boom-up confluence flow path 6;

a first arm control valve 8 that is installed on a downstream side of the discharge flow path 1 of the first hydraulic pump P1 and is configured to be shifted to control a start, a stop, and a direction change of the arm cylinder 2;

a second arm control valve 10 that is installed on a downstream side of the discharge flow path 3 of the second hydraulic pump P2 and is configured to be shifted to allow a hydraulic fluid discharged from the second hydraulic pump P2 to join a hydraulic fluid supplied to the arm cylinder 2 from the first hydraulic pump P1 through an arm-in confluence flow path 9; and a spool 12 (referring to a spool for controlling a pilot signal pressure to shift the second boom control valve 7) for the second boom control valve 7, which is configured to be shifted depending on whether an arm-in pilot pressure is higher or lower than a set pressure so that the second boom control valve 7 is shifted to a neutral position (i.e., a position "a") if the arm-in pilot pressure is equal to or higher than the set pressure, and the second boom control valve 7 is shifted to a position (i.e., a position "b") to allow the hydraulic fluid from the first hydraulic pump P1 to join the hydraulic fluid supplied to the boom cylinder 4 if the arm-in pilot pressure is lower than the set pressure.

A non-explained reference numeral 13 denotes a boom manipulation lever, and a non-explained reference numeral 14 denotes an arm manipulation lever.

A) The single boom-up operation will be described hereinafter.

In the case where the boom manipulation lever 13 is manipulated to ascend the boom, a spool of the second boom control valve 7 is shifted to the left on the drawing sheet by a boom-up pilot pressure partially applied to the position "b" of spool 12 for the second boom control valve. For this reason, the hydraulic fluid discharged from the first hydraulic pump P1 joins a hydraulic fluid of the boom-up confluence flow path 6 via the discharge flow path 1, the parallel flow path 15 of the first hydraulic pump P1, a check valve, and the second boom control valve 7 in this order. Simultaneously, a part of the boom-up pilot pressure causes a spool of the first boom control valve 5 to be shifted to the right on the drawing sheet. For this reason, the hydraulic fluid discharged from the second hydraulic pump P2 passes through the discharge flow path 3, the parallel flow path 16, the check valve, and the first boom control valve 5 in this order, and then is supplied to the boom cylinder 4 via the boom-up confluence flow path 6.

Thus, when the boom manipulation lever 13 is manipulated, the boom cylinder 4 can be driven to a boom-up state by the hydraulic fluids discharged from the first and second hydraulic pumps P1 and P2.

B) The single arm-in operation will be described hereinafter.

In the case where the arm manipulation lever 14 is manipulated to perform an arm-in operation, apart of the arm-in pilot pressure causes a spool of the first arm control valve 8 to be shifted to the right on the drawing sheet. For this reason, the hydraulic fluid discharged from the first hydraulic pump P1 is supplied to the arm cylinder 2 via the discharge flow path 1, the parallel flow path 15, the check valve, and the first arm control valve 8 in this order. Simultaneously, apart of the arm-in pilot pressure causes a spool of the second arm control valve 10 to be shifted to the left on the drawing sheet. For this reason, the hydraulic fluid discharged from the second hydraulic pump P2 passes through the discharge flow path 3, the parallel flow path 16 of the second hydraulic pump P2, the check valve, and the second arm control valve 10 in this order, and then joins is supplied to the arm cylinder 2 via the arm-in confluence flow path 9.

Thus, when the arm manipulation lever 14 is manipulated, the arm cylinder 2 can be driven to an arm-in state by the hydraulic fluids discharged from the first and second hydraulic pumps P1 and P2.

C) The combined boom-up and arm-in operation will be described hereinafter.

In the case where a combined operation is performed in which the manipulation lever 14 and the boom manipulation lever 13 are operated simultaneously to carry out a ground leveling work that flattens a ground surface, the arm-in pilot pressure according to the arm manipulation lever 14 causes the spool 12 for the second boom control valve 7 to be shifted to a position "a". In other words, when the pilot pressure which shifts the spool 18 for the second boom control valve 7, is blocked to cause the spool 12 for the second boom control valve 7 to be shifted to a neutral position, the supply of the hydraulic fluid of the first hydraulic pump P1 to the boom-up confluence flow path 6 via the second boom control valve 7 is interrupted.

Thus, the boom cylinder 4 can be driven to a boom-up state only by the hydraulic fluid supplied from the second hydraulic pump P2.

Meanwhile, the boom-up pilot pressure according to the manipulation of the boom manipulation lever 13 causes the spool 17 for the second arm control valve 10 (referring to a spool for controlling the parallel flow path 16 connected to the second arm control valve 10) to be shifted to the top on the drawing sheet. For this reason, the supply of the hydraulic fluid discharged from the second hydraulic pump P2 to the arm cylinder 2 via the discharge flow path 3, the parallel flow path 16, the spool 17, the check valve, and the second arm control valve 10 is interrupted.

Thus, the arm cylinder 2 can be driven to an arm-in state only by the hydraulic fluid supplied from the first hydraulic pump P1.

The above conventional hydraulic system for a construction machine entails a problem in that when the ground leveling work is performed by the simultaneous operation of the arm manipulation lever 14 and the boom manipulation lever 13, it is not smoothly carried out due to a variation in a distribution of the hydraulic fluids of the first and second hydraulic pumps P1 and P2 and a load of the attachment such as a boom, or the like.

For this reason, in an attempt to solve the above problem involved in the conventional hydraulic system, a cross section of a spool notch for the arm-in and boon-up operation is made small to increase a load of the first and second hydraulic pumps (for example, the case where a load is applied to a return side to control the speed to be reduced), thereby improving manipulability. In this case, since the load of the first and second hydraulic pumps is increased due to the small cross section of the notch, the drive speed of the actuator becomes low and a pressure loss is increased to increase the amount of heat generated, thereby decreasing the fuel efficiency.

DETAILED DESCRIPTION OF THE INVENTION

Technical Problems

Accordingly, the present invention has been made to solve the aforementioned problem occurring in the prior art, and it is an object of the present invention to provide a hydraulic system for a construction machine, in which manipulability and fuel efficiency are improved during aground leveling work that flattens a ground surface through the simultaneous performance of boom-up and arm-in operations and the necessity for a separate control valve is eliminated to reduce the manufacturing cost.

Technical Solution

To accomplish the above object, in accordance with an embodiment of the present invention, there is provided a hydraulic system for a construction machine in accordance with an embodiment of the present invention, the system including:

first and second hydraulic pumps and a pilot pump, which are connected to an engine;

an arm cylinder connected to a discharge flow path 1 of the first hydraulic pump;

a boom cylinder connected to a discharge flow path 3 of the second hydraulic pump;

a first boom control valve installed on an upstream side of the discharge flow path of the second hydraulic pump and configured to be shifted to control a start, a stop, and a direction change of the boom cylinder;

a second boom control valve installed on an upstream side of the discharge flow path of the first hydraulic pump and configured to be shifted to allow a hydraulic fluid discharged from the first hydraulic pump to join a hydraulic fluid supplied to the boom cylinder from the second hydraulic pump through a boom-up confluence flow path;

a first arm control valve installed on a downstream side of the discharge flow path of the first hydraulic pump and configured to be shifted to control a start, a stop, and a direction change of the arm cylinder;

a second arm control valve installed on a downstream side of the discharge flow path of the second hydraulic pump and configured to be shifted to allow a hydraulic fluid discharged from the second hydraulic pump to join a hydraulic fluid supplied to the arm cylinder from the first hydraulic pump through an arm-in confluence flow path;

a regeneration valve installed in a flow path between a hydraulic fluid inlet port of the first arm control valve and a hydraulic tank; and a spool for the second boom control valve composed of a first port configured to be shifted depending on whether an arm-in pilot pressure is higher or lower than a set pressure to allow the second boom control valve to be shifted to a neutral position if the arm-in pilot pressure is equal to or higher than the set pressure, a second port configured to form a parallel pressure section in which the pilot pressure is not increased relative to a boom-up stroke, and a third port configured to shift the second boom control valve to allow the hydraulic fluid from the first hydraulic pump to join the hydraulic fluid from the second hydraulic pump if the arm-in pilot pressure is lower than the set pressure.

In accordance with a preferred embodiment of the present invention, the hydraulic system for a construction machine may further include a shuttle valve having an inlet side connected to a boom-up pilot pressure and a swing pilot pressure and an outlet side connected to a back pressure chamber of the regeneration valve, and configured to form the back pressure through the supply of a pilot pressure selected from the boom-up pilot pressure and the swing pilot pressure to the back pressure chamber.

ADVANTAGEOUS EFFECT

The hydraulic system for a construction machine in accordance with an embodiment of the present invention as constructed above has the following advantages.

Manipulability is improved during a ground leveling work that flattens a ground surface through the simultaneous performance of boom-up and arm-in operations, thereby reducing an operator's fatigue and improving fuel efficiency. In addition, the necessity for a separate control valve for controlling the ground leveling work is eliminated to reduce the manufacturing cost.

BRIEF DESCRIPTION OF THE DRAWINGS

The above objects, other features and advantages of the present invention will become more apparent by describing the preferred embodiments thereof with reference to the accompanying drawings, in which.

EXPLANATION ON REFERENCE NUMERALS OF MAIN ELEMENTS IN THE DRAWINGS

Figure 1:
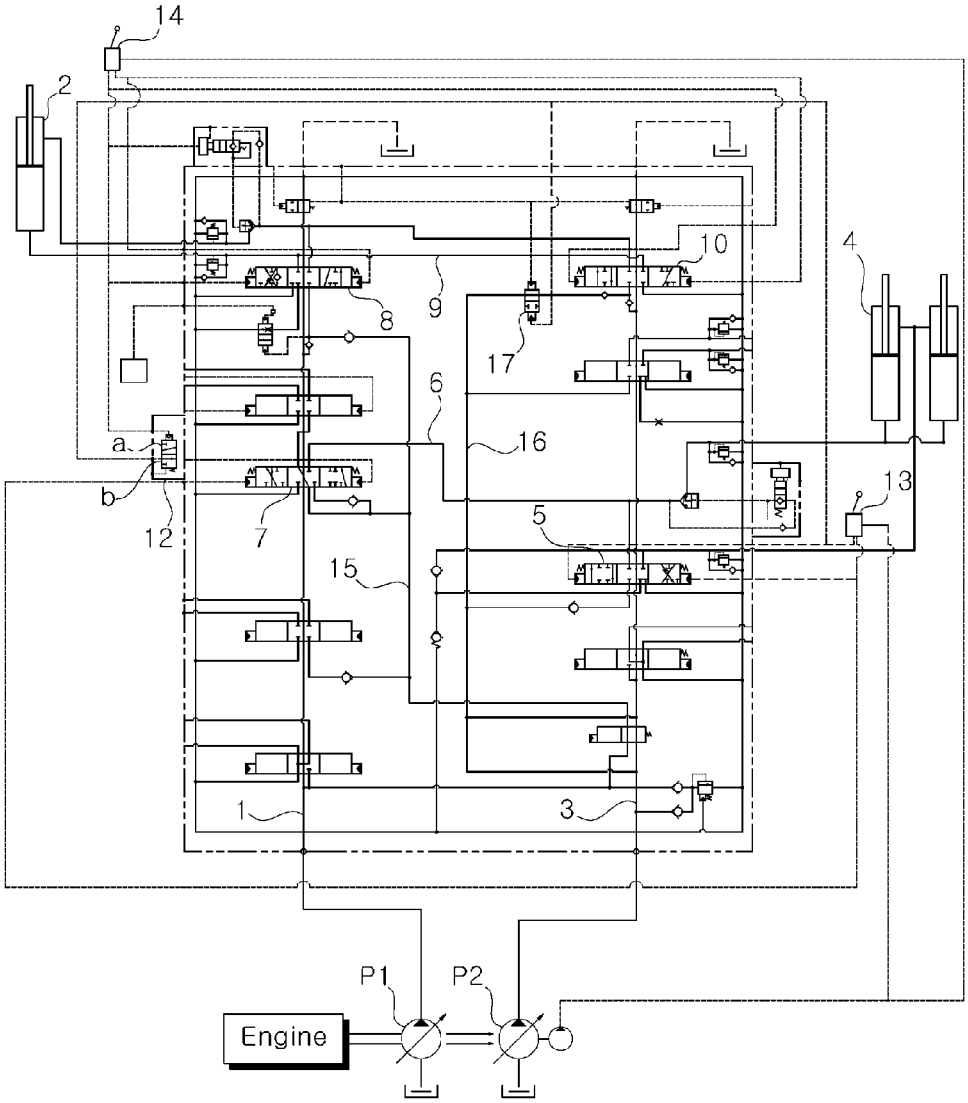
FIG. 1 is a hydraulic circuit diagram showing a hydraulic system for a construction machine in accordance with the prior art.

1,3: discharge flow path
2: arm cylinder
4: boom cylinder
5: first boom control valve
6: boom-up confluence flow path
7: second boom control valve
8: first arm control valve
9: arm-in confluence flow path
10: second arm control valve
13: boom manipulation lever
14: arm manipulation lever
15,16: parallel flow path
17,18: spool
19: regeneration valve
21: shuttle valve Preferred Embodiments Of The Invention Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 2:
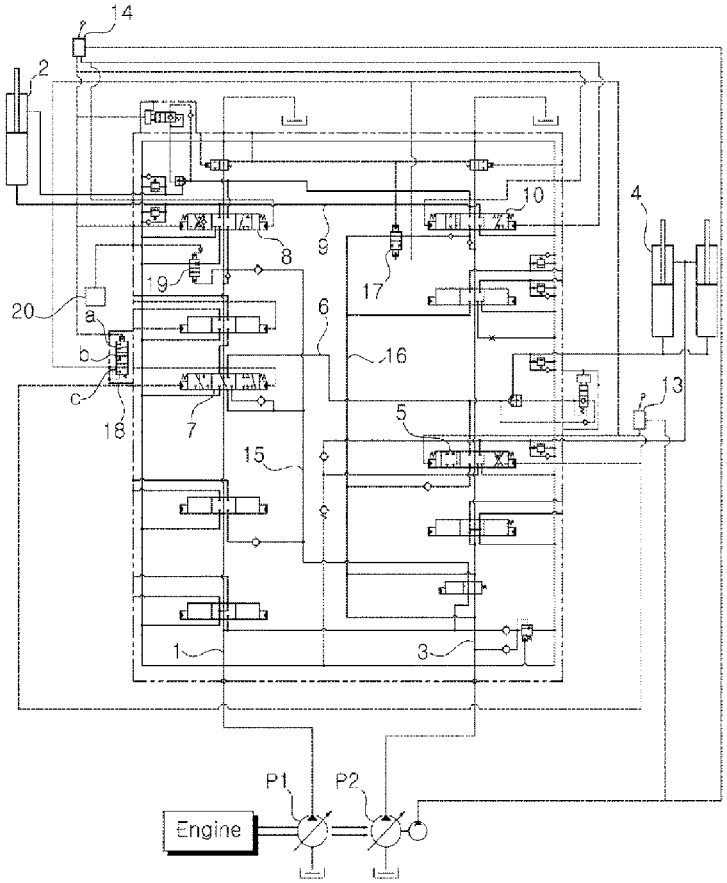
FIG. 2 is a hydraulic circuit diagram of a hydraulic system for a construction machine in accordance with an embodiment of the present invention.
Figure 3A:
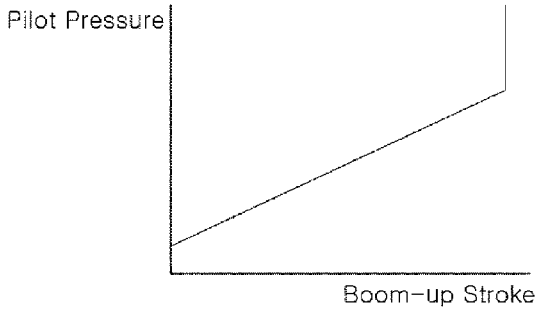
FIGS. 3(*a*) and 3(*b*) are graphs showing the relationship between a boom-up pilot pressure and a boom-up stroke during a combined boom-up and arm-in operation in a hydraulic system for a construction machine in accordance with an embodiment of the present invention.
Figure 3B:
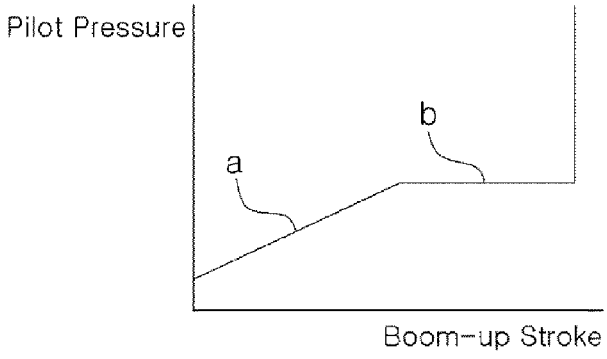
Figure 4:
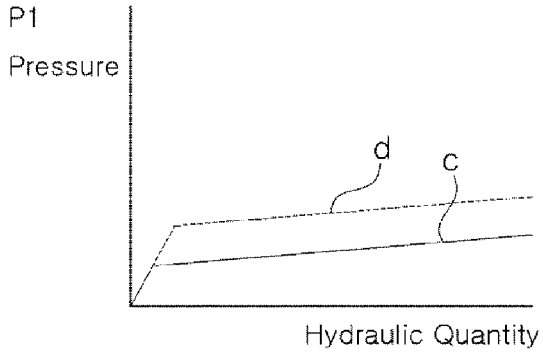
FIG. 4 is a graph showing a state in which a load is increased at a return side of an arm-in side during a combined boom-up and arm-in operation in a hydraulic system for a construction machine in accordance with an embodiment of the present invention

As shown in FIGS. 2 to 4, a hydraulic system for a construction machine in accordance with an embodiment of the present invention includes:

first and second hydraulic pumps P1 and P2 and a pilot pump, which are connected to an engine (not shown);

an arm cylinder 2 that is connected to a discharge flow path 1 of the first hydraulic pump P1;

a boom cylinder 4 that is connected to a discharge flow path 3 of the second hydraulic pump P2;

a first boom control valve 5 that is installed on an upstream side of the discharge flow path 3 of the second hydraulic pump P2 and is configured to be shifted to control a start, a stop, and a direction change of the boom cylinder 4;

a second boom control valve 7 that is installed on an upstream side of the discharge flow path 1 of the first hydraulic pump P1 and is configured to be shifted to allow a hydraulic fluid discharged from the first hydraulic pump P1 to join a hydraulic fluid supplied to the boom cylinder 4 from the second hydraulic pump P2 through a boom-up confluence flow path 6;

a first arm control valve 8 that is installed on a downstream side of the discharge flow path 1 of the first hydraulic pump P1 and is configured to be shifted to control a start, a stop, and a direction change of the arm cylinder 2;

a second arm control valve 10 that is installed on a downstream side of the discharge flow path 3 of the second hydraulic pump P2 and is configured to be shifted to allow a hydraulic fluid discharged from the second hydraulic pump P2 to join a hydraulic fluid supplied to the arm cylinder 2 from the first hydraulic pump P1 through an arm-in confluence flow path 9;

a regeneration valve 19 that is installed in a flow path between a hydraulic fluid inlet port of the first arm control valve 8 and a hydraulic tank; and a spool 18 (referring to a spool for controlling a pilot signal pressure to shift the second boom control valve 7) for the second boom control valve 7, which is composed of a first port (referring to a position "a") configured to be shifted depending on whether an arm-in pilot pressure is higher or lower than a set pressure to allow the second boom control valve 7 to be shifted to a neutral position if the arm-in pilot pressure is equal to or higher than the set pressure, a second port (referring to a position "b") configured to form a parallel pressure section in which the pilot pressure is not increased relative to a boom-up stroke, and a third port (referring to a position "c") configured to shift the second boom control valve 7 to allow the hydraulic fluid from the first hydraulic pump P1 to join the hydraulic fluid from the second hydraulic pump P2 if the arm-in pilot pressure is lower than the set pressure.

The hydraulic system for a construction machine further includes a shuttle valve 21 having an inlet side connected to a boom-up pilot pressure and a swing pilot pressure and an outlet side connected to a back pressure chamber of the regeneration valve 19, and configured to form the back pressure through the supply of a pilot pressure selected from the boom-up pilot pressure and the swing pilot pressure to the back pressure chamber.

In this case, a configuration of the hydraulic system for a construction machine in accordance with the present invention is the same as that of the hydraulic system for a construction machine shown in FIG. 1, except the spool 18 for the second boom control valve 7 and the shuttle valve 21. Thus, the detailed description of the same configuration and operation thereof will be omitted to avoid redundancy, and the same elements are denoted by the same reference numerals.

Hereinafter, a use example of the hydraulic system for a construction machine in accordance with an embodiment of the present invention will be described in detail with reference to the accompanying drawings.

As shown in FIG. 2, in the case where the boom manipulation lever 13 is manipulated to ascend the boom, a spool of the first boom control valve 5 is shifted to the right on the drawing sheet by a boom-up pilot pressure. For this reason, the hydraulic fluid discharged from the second hydraulic pump P2 is supplied to the boom-up confluence flow path 6 via the first boom control valve 5. Simultaneously, the boom-up pilot pressure is applied to a position "c" of the spool 18 for the second boom control valve 7 to cause a spool of the second boom control valve 7 to be shifted to the left on the drawing sheet. For this reason, the hydraulic fluid discharged from the first hydraulic pump P1 joins a hydraulic fluid of the boom-up confluence flow path 6 via the second boom control valve 7.

Thus, the boom cylinder 4 can be driven to a boom-up state by the hydraulic fluids discharged from the first and second hydraulic pumps P1 and P2 through the manipulation of the boom manipulation lever 13

As shown in FIG. 2, in the case where the arm manipulation lever 14 is manipulated to perform an arm-in operation, a spool of the first arm control valve 8 is shifted to the right on the drawing sheet by an arm-in pilot pressure. For this reason, the hydraulic fluid discharged from the first hydraulic pump P1 is supplied to the arm-in confluence flow path 9 via the first arm control valve 8. Simultaneously, the arm-in pilot pressure causes a spool of the second arm control valve 10 to be shifted to the left on the drawing sheet. For this reason, the hydraulic fluid discharged from the second hydraulic pump P2 joins a hydraulic fluid of the arm-in confluence flow path 9 via the second arm control valve 10.

Thus, the arm cylinder 2 can be driven to an arm-in state by the hydraulic fluids discharged from the first and second hydraulic pumps P1 and P2 through the manipulation of the arm manipulation lever 14

Meanwhile, in the case a combined operation is performed in which the boom manipulation lever 13 and the arm manipulation lever 14 are simultaneously operated to carry out a ground leveling work that flattens a ground surface, the arm-in pilot pressure according to the arm manipulation lever 14 causes the spool 18 for the second boom control valve 7 to be shifted to a position "a". In other words, when the pilot pressure which shifts the spool 18 for the second boom control valve 7, is blocked to cause the spool 18 for the second boom control valve 7 to be shifted to a neutral position, the supply of the hydraulic fluid of the first hydraulic pump P1 to the boom-up confluence flow path 6 via the second boom control valve 7 is interrupted. Thus, the boom cylinder 4 can be driven to a bum-up state only by the hydraulic fluid supplied from the second hydraulic pump P2.

As shown in FIG. 3(*b*), it could be confirmed that a boom-up pilot pressure is increased relative to a boom-up stroke in a given section at an initial stage (see an inclined section "a" in the graph), and then is maintained in a given section but not increased any more (see a horizontal section of the graph).

In other words, in the case the boom manipulation lever 13 and the arm manipulation lever 14 are simultaneously operated to carry out a grading work, the boom-up stroke can be controlled to be shortened by the second port (referring to a position "b) of the spool 18 for the second boom control valve 7. For this reason, since the fluctuation range of a work apparatus or an attachment in the vertical direction is small, an operator can manipulate the attachment while focusing only the arm-in operation during the grounding leveling work so that the manipulation of the attachment can be facilitated and the operator's fatigue can be alleviated.

In the meantime, in the case where the ground leveling work is carried out, when the boom manipulation lever 13 is manipulated, a spool 17 for the second arm control valve 10 is shifted to the top on the drawing sheet by the boom-up pilot pressure to interrupt the supply of the hydraulic fluid discharged from the second hydraulic pump P2 to the arm-in confluence flow path 9. Thus, the arm cylinder 2 can be driven to an arm-in state only by the hydraulic fluid supplied from the first hydraulic pump P1.

As shown in FIG. 4, any one pilot pressure selected from a boom-up pilot pressure according to the manipulation of the boom manipulation lever 13, which is applied to the shuttle valve 21, and a pilot pressure according to the manipulation of the swing manipulation lever 20 is supplied to a back pressure chamber of the regeneration valve 19. That is, when the arm-in operation of the arm cylinder 2 for the ground leveling work is performed, a fine load can be increased at a return side by the regeneration valve 19.

For this reason, it could be confirmed that a load is relatively increased at a return side of the arm-in side (see an inclined section "d" of the graph) during the ground leveling work through the simultaneous performance of boom-up and arm-in operations as compared to the flow rate of a hydraulic fluid supplied to the arm cylinder 2 (see an inclined section "c" of the graph) during a single arm-in operation.

Therefore, the arm cylinder 2 is smoothly driven during the ground leveling work, thereby improving manipulability.

INDUSTRIAL APPLICABILITY

As described above, according to the hydraulic system for a construction machine in accordance with an embodiment of the present invention, manipulability and fuel efficiency are improved during the ground leveling work that flattens aground surface through the simultaneous performance of boom-up and arm-in operations and the necessity for a separate control valve for controlling the ground leveling work is eliminated to reduce the manufacturing cost.

The invention claimed is:

1. A hydraulic system for a construction machine comprising:

first and second hydraulic pumps P1 and P2 and a pilot pump, which are connected to an engine;

an arm cylinder connected to a discharge flow path of the first hydraulic pump P1;

a boom cylinder connected to a discharge flow path of the second hydraulic pump P2;

a first boom control valve installed on an upstream side of the discharge flow path of the second hydraulic pump P2 and configured to be shifted to control a start, a stop, and a direction change of the boom cylinder;

a second boom control valve installed on an upstream side of the discharge flow path of the first hydraulic pump P1 and configured to be shifted to allow a hydraulic fluid discharged from the first hydraulic pump P1 to join a hydraulic fluid supplied to the boom cylinder from the second hydraulic pump P2 through a boom-up confluence flow path;

a first arm control valve installed on a downstream side of the discharge flow path of the first hydraulic pump P1 and configured to be shifted to control a start, a stop, and a direction change of the arm cylinder;

a second arm control valve installed on a downstream side of the discharge flow path of the second hydraulic pump P2 and configured to be shifted to allow a hydraulic fluid discharged from the second hydraulic pump P2 to join a hydraulic fluid supplied to the arm cylinder from the first hydraulic pump P1 through an arm-in confluence flow path;

a valve installed in a flow path between a hydraulic fluid inlet port of the first arm control valve and a hydraulic tank; and a spool for the second boom control valve composed of a first port configured to be shifted depending on whether an arm-in pilot pressure is higher or lower than a set pressure to allow the second boom control valve to be shifted to a neutral position if the arm-in pilot pressure is equal to or higher than the set pressure, a second port configured to form a parallel pressure section in which the pilot pressure is not increased relative to a boom-up stroke, and a third port configured to shift the second boom control valve to allow the hydraulic fluid from the first hydraulic pump P1 to join the hydraulic fluid from the second hydraulic pump P2 if the arm-in pilot pressure is lower than the set pressure.

2. The hydraulic system for a construction machine according to claim 1, further comprising a shuttle valve having an inlet side connected to a boom-up pilot pressure and a swing pilot pressure and an outlet side connected to a back pressure chamber of the valve, and configured to form the back pressure through the supply of a pilot pressure selected from the boom-up pilot pressure and the swing pilot pressure to the back pressure chamber.

* * * * *